US010787984B2

(12) United States Patent
Charbonnel et al.

(10) Patent No.: US 10,787,984 B2
(45) Date of Patent: Sep. 29, 2020

(54) POWER SYSTEM OPTIMIZATION CALIBRATION

(71) Applicant: Caterpillar Inc., Deerfield, IL (US)

(72) Inventors: Sylvain Charbonnel, Peoria, IL (US); Gavin Williams, Lincolnhire (GB); Mark Scaife, Huntingdon (GB); Anand Krishnamurthygopalan, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/243,746

(22) Filed: Jan. 9, 2019

(65) Prior Publication Data

US 2020/0049094 A1 Feb. 13, 2020

Related U.S. Application Data

(63) Continuation-in-part of application No. 16/058,890, filed on Aug. 8, 2018.

(51) Int. Cl.
*F02D 41/28* (2006.01)
*F02D 41/40* (2006.01)
(Continued)

(52) U.S. Cl.
CPC ..... *F02D 41/28* (2013.01); *F02B 77/084* (2013.01); *F02D 17/02* (2013.01);
(Continued)

(58) Field of Classification Search
CPC ..... F02D 41/1406; F02D 41/1462; F02D 41/401; F02D 41/402; F02D 41/3809;
(Continued)

(56) References Cited

U.S. PATENT DOCUMENTS 6,845,609 B2 1/2005 Oguma
6,941,219 B2 9/2005 Avery, Jr. et al.
(Continued)

FOREIGN PATENT DOCUMENTS

CN 102798530 B 7/2015
GB 2460397 A 12/2009
WO 1992009957 A1 6/1992

*Primary Examiner* — Sizo B Vilakazi
*Assistant Examiner* — Anthony L Bacon
(74) *Attorney, Agent, or Firm* — Hibshman Claim Construction PLLC

(57) ABSTRACT

Power system optimization calibration is disclosed. An example implementation includes receiving, by an engine control module, calibration information associated with optimizing an operating characteristic of a power system; determining, by the engine control module and using an optimization model, an optimization profile to optimize the operating characteristic, wherein the optimization model is configured to perform one or more optimization processes to determine, according to the calibration information, optimized values associated with adjustable parameters of the power system, wherein the optimization profile is configured to include the optimized values; and configuring, by the engine control module, a first control device, associated with a first adjustable parameter of the adjustable parameters, according to the optimization profile, wherein the first control device is configured to control a first component of an engine of the power system to be set according to an optimized value for the first adjustable parameter.

19 Claims, 4 Drawing Sheets

(51) Int. Cl.
*F02D 17/02* (2006.01)
*F02D 41/00* (2006.01)
*F02B 77/08* (2006.01)

(52) U.S. Cl.
CPC ..... *F02D 41/0002* (2013.01); *F02D 41/401* (2013.01); *F02D 41/402* (2013.01)

(58) Field of Classification Search
CPC .... F02D 41/3082; G05B 17/02; B60W 10/06; B60W 30/188
See application file for complete search history.

(56) References Cited

U.S. PATENT DOCUMENTS 7,047,125 B1 5/2006 He et al.
7,107,142 B2 9/2006 Harada et al.
9,103,248 B2 8/2015 Light-Holets
9,146,545 B2 9/2015 Stewart
9,546,612 B2 1/2017 Ge et al.
9,764,812 B1 9/2017 Arbuckle et al.
9,797,318 B2 10/2017 Storch et al.
2007/0073467 A1* 3/2007 Hill ..... F02D 35/02 701/105
2007/0203864 A1* 8/2007 Grichnik ..... F02D 41/1462 706/44
2009/0070019 A1* 3/2009 Heap ..... B60K 6/445 701/112
2014/0148928 A1* 5/2014 Stewart ..... G05B 13/02 700/32
2016/0011571 A1* 1/2016 Mayr ..... G05B 17/02 700/29
2016/0144863 A1* 5/2016 Bevan ..... F01N 3/208 701/54
2017/0168466 A1* 6/2017 Sun ..... G05B 13/026
2018/0058350 A1* 3/2018 Zhu ..... F02B 17/005
2018/0209675 A1* 7/2018 Ridder ..... F24F 11/62
2018/0274467 A1* 9/2018 Garimella ..... F02D 41/0052
2018/0313285 A1* 11/2018 Aso ..... F02D 41/1401
2019/0063353 A1* 2/2019 Merlino ..... F02D 35/028
2019/0293013 A1* 9/2019 Schaub ..... F02D 41/1406

* cited by examiner

POWER SYSTEM OPTIMIZATION CALIBRATION

This application is a continuation-in-part of U.S. patent application Ser. No. 16/058,890, filed on Aug. 8, 2018, the content of which is incorporated by reference herein in its entirety.

TECHNICAL FIELD

The present disclosure relates generally to power systems and, more particularly, to power system optimization calibration.

BACKGROUND

Engine optimization involves configuring an engine to operate in an optimized manner according to an optimization process. For example, the optimization process may configure an engine to run, according to the optimization process, with a certain level of efficiency, with a certain level of emissions, with a certain level of performance (e.g., speed output, torque output, and/or the like), and/or the like. An engine control module (ECM) may run the optimization process in real time and adjust one or more operational parameters according to the findings of the optimization process. Such an optimization process is typically configured and/or calibrated during manufacturing and/or testing for the engine and, thus, individual needs or uses the engine may not be addressed by the optimization processes.

U.S. Pat. No. 9,797,318 to Storch et al., issued on Oct. 24, 2017 ("the '318 patent"), describes "calibration systems and methods for model predictive controllers." The '318 patent describes using "calibration data stored [ . . . ] that includes predetermined values for variables referenced in [ . . . ] object code" and a processor that "executes the object code using the predetermined values." The '318 patent further describes that "user(s) may [ . . . ] design [the object] code for determining how much to weight each predicted parameter/set point relationship in determining [a] cost."

While the calibration systems and methods of the '318 patent may describe calibrating model predictive controllers, the '318 patent does not disclose optimizing an operating characteristic of an engine of a power system by optimizing, during operation of the engine, a variable number of parameters and/or variable sets of parameters.

The power system optimizer of the present disclosure solves the ability to calibrate optimization processes to optimize specific operating characteristics of an engine according to individual needs or uses for the engine and/or other problems in the art.

SUMMARY

According to some implementations, an engine control module may include a memory and one or more processors to: receive calibration information to optimize an operating characteristic associated with operating a power system; determine an optimization profile for operating the power system using an optimization model, wherein the optimization profile is configured to specify optimized values for a plurality of adjustable parameters of the power system, and wherein the optimization model is configured to: iteratively perform one or more optimization processes to determine, according to the one or more optimization processes, potential optimized values for the plurality of adjustable parameters to control the power system, and selectively designate, within the optimization profile and based on the calibration information, respective optimized values, from the potential optimized values, for the plurality of adjustable parameters; and configure one or more control devices, associated with the plurality of adjustable parameters, according to the optimization profile to control the power system to optimize the operating characteristic.

According to some implementations, a power system may include an engine; one or more control devices; one or more sensors; one or more calibration devices; and an engine control module to: receive, from the one or more calibration devices, calibration information, wherein the calibration information indicates an operating characteristic of the engine that is to be optimized; based on receiving the calibration information, configure an optimization model of the engine control module, wherein the optimization model is configured to perform one or more optimization processes, according to the calibration information and based on measurements received from the one or more sensors, to optimize a plurality of adjustable parameters associated with one or more of the one or more control devices; determine an optimization profile for optimizing the operating characteristic based on the optimization model performing the one or more optimization processes, wherein the optimization profile indicates optimized values determined, according to the one or more optimization processes, for the plurality of adjustable parameters; and configure the one or more control devices to control the engine according to the optimization profile.

According to some implementations, a method may include receiving calibration information associated with optimizing an operating characteristic of a power system; determining, using an optimization model, an optimization profile to optimize the operating characteristic, wherein the optimization model is configured to perform one or more optimization processes to determine, according to the calibration information, optimized values associated with a plurality of adjustable parameters of the power system, wherein the optimization profile is configured to include the optimized values; and configuring a first control device, associated with a first adjustable parameter of the plurality of adjustable parameters, according to the optimization profile, wherein the first control device is configured to control a first component of an engine of the power system to be set according to an optimized value for the first adjustable parameter.

DETAILED DESCRIPTION

This disclosure relates to power system optimization calibration using a power system optimizer of an engine control module (ECM). The power system optimizer, as described herein, has universal applicability to any machine utilizing such a power system optimizer. The term "machine" may refer to any machine that performs an operation associated with an industry such as, for example, mining, construction, farming, transportation, or any other industry. As some examples, the machine may be a vehicle, a backhoe loader, a cold planer, a wheel loader, a compactor, a feller buncher, a forest machine, a forwarder, a harvester, an excavator, an industrial loader, a knuckleboom loader, a material handler, a motor grader, a pipelayer, a road reclaimer, a skid steer loader, a skidder, a telehandler, a tractor, a dozer, a tractor scraper, or other above ground equipment, underground equipment, aerial equipment, or marine equipment. Moreover, one or more implements may be connected to the machine and driven from the power system optimizer, as described herein.

Figure 1:
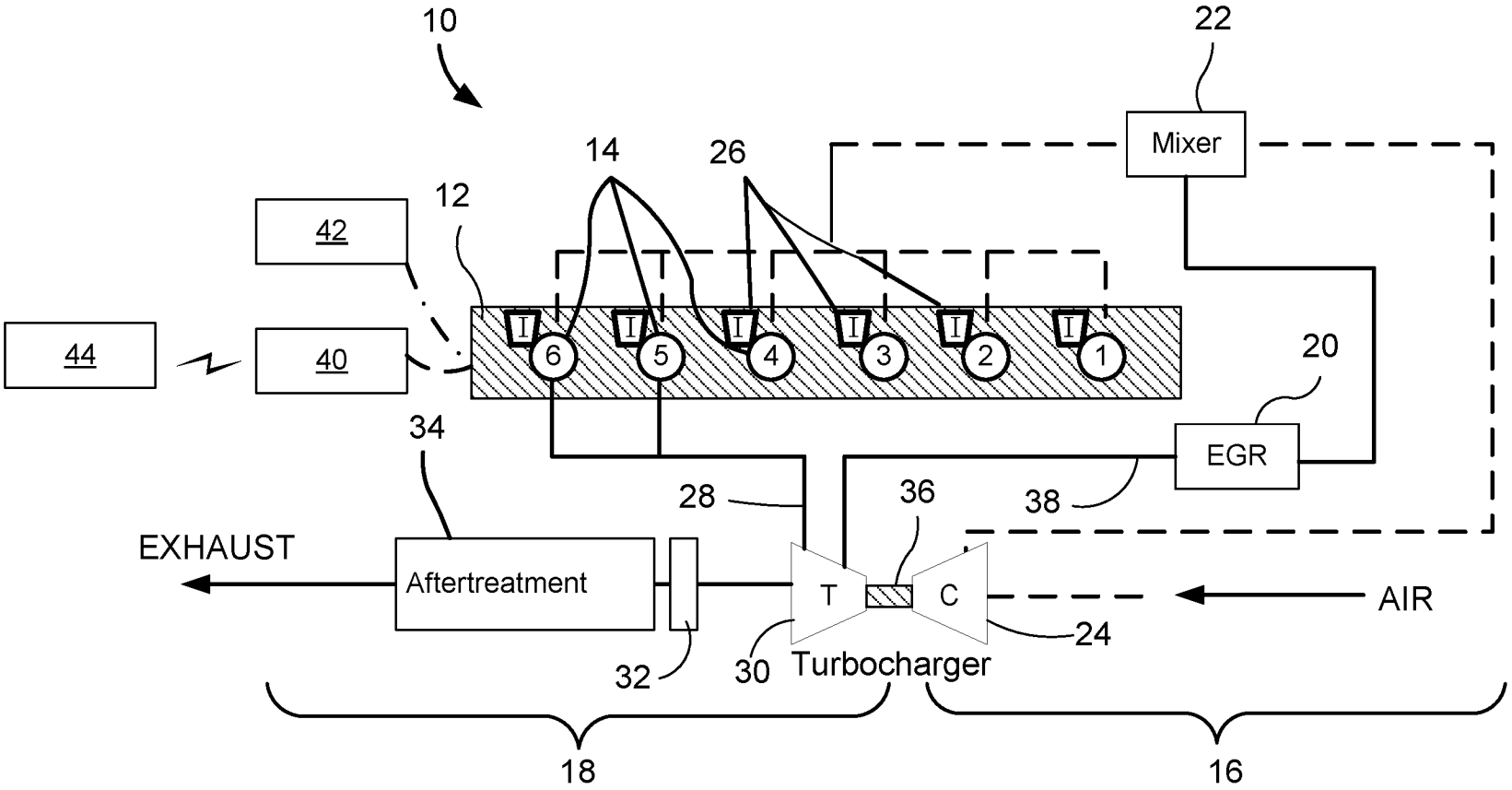
FIG. 1 is a diagram of an example power system described herein.

FIG. 1 is a diagram of an example power system 10 described herein. The power system 10 may be described herein as a compression ignition, internal combustion engine. However, the power system 10 may include any other type of internal combustion engine, such as, for example, a spark, laser, a plasma ignition engine, and/or the like. The power system 10 may be fueled by such fuels as distillate diesel fuel, biodiesel, dimethyl ether, gaseous fuels, such as hydrogen, natural gas, propane, alcohol, ethanol, and/or any combination thereof.

Power system 10, of FIG. 1, includes an engine block 12 with a plurality of cylinders 14 (engine block 12 of FIG. 1 is shown with six cylinders 14). A piston assembly may be included within each of cylinders 14 to form a combustion chamber within each cylinder 14. Power system 10 may include any number of combustion chambers, and the combustion chambers may be disposed in an in-line configuration, a "V" configuration, or in any other suitable configuration. Furthermore, the power system 10 may consume one or more consumable resources (e.g., a fuel (e.g., gasoline, diesel fuel, and/or the like), a diesel exhaust fluid (DEF), one or more coolants, one or more lubricants (e.g., an oil, a grease, and/or the like), and/or the like) during operation (e.g., due to combustion in the engine block).

Power system 10 may include multiple systems. For example, as shown in the example of FIG. 1, power system 10 may include an air intake or air induction system 16, an exhaust system 18, and an exhaust gas recirculation (EGR) system 20. Air induction system 16 may be configured to direct air, or an air and fuel mixture (e.g., of air and another gas, such as exhaust gas) into power system 10 for subsequent combustion. Exhaust system 18 may exhaust or release byproducts of the combustion to an atmosphere external to power system 10. A recirculation loop of the EGR system 20 may be configured to direct a portion of the exhaust gases from exhaust system 18 back into air induction system 16 for subsequent combustion.

Air induction system 16 may include multiple components that cooperate to condition and introduce compressed air into cylinders 14. For example, air induction system 16 may include a mixer 22, or intake manifold, located downstream of one or more compressors 24. The air induction system 16 feeds variable valve actuators 26 associated with respective ones of cylinders 14. In some implementations, air induction system 16 may include a throttle valve, an air cooler, a filtering component, a compressor bypass component, and/or the like. As described herein, various adjustable parameters (e.g., controllable parameters or parameters that are capable of being controlled by a control device) associated with air induction system 16 may be optimized according to an optimization process. For example, an optimization process may be iteratively performed to identify an optimized value for a pressure level of air when the air enters a combustion chamber (e.g., by adjusting a setting of compressor 24), optimized timing of the air as the air enters the combustion chamber (e.g., by adjusting opening and closing timing of variable valve actuators 26), an optimized intake throttle valve position (e.g., by adjusting a position of an intake throttle valve of air induction system 16), and/or the like.

Exhaust system 18 may include multiple components that cooperate to condition and direct exhaust from cylinders 14 to the atmosphere. For example, exhaust system 18 may include an exhaust passageway 28, one or more turbines 30 driven by exhaust flowing through exhaust passageway 28, a particulate collection device 32, such as a diesel particulate filter (DPF) located downstream of turbine 30, and an exhaust aftertreatment device 34 (e.g., an aftertreatment selective catalytic reduction (SCR)) fluidly connected downstream of particulate collection device 32. In some implementations, exhaust system 18 may include one or more bypass components, an exhaust compression or restriction brake, an attenuation device, additional exhaust treatment devices, and/or the like.

Turbine 30 may be located to receive exhaust leaving power system 10, and may be connected to the one or more compressors 24 of air induction system 16 by way of a common shaft 36 to form a turbocharger. As exhaust gases exiting power system 10 flow through turbine 30 and expand against vanes thereof, turbine 30 may rotate and drive the one or more compressors 24 to pressurize inlet air.

In some implementations, particulate collection device 32 may be a DPF located downstream of turbine 30 to remove particulate matter from the exhaust flow of power system 10. In some implementations, particulate collection device 32 may include an electrically conductive or non-conductive coarse mesh metal or porous ceramic honeycomb medium. As the exhaust flows through the medium, particulates may be blocked by and trapped in the medium. Over time, the particulates may build up within the medium and, if unaccounted for, could affect engine performance by increasing exhaust backpressure. To minimize backpressure effects on engine performance, the collected particulates may be passively and/or actively removed through a regeneration process. When passively regenerated, the particulates deposited on the medium may chemically react with a catalyst, for example, a base metal oxide, a molten salt, and/or a precious metal that is coated on or otherwise included within particulate collection device 32 to lower the ignition temperature of the particulates. Because particulate collection device 32 may be closely located downstream of engine block 12 (e.g., immediately downstream of turbine 30, in one example), the temperatures of the exhaust flow entering particulate collection device 32 may be controlled to be high enough, in combination with the catalyst, to burn away the trapped particulates. When actively regenerated, heat is applied to the particulates deposited on the filtering medium to elevate the temperature thereof to an ignition threshold. In accordance with yet other implementations described herein, an active regeneration device (not shown), such as a fuel-fired burner or an electric heater, may be located proximal to (e.g., upstream of) particulate collection device 32 to assist in controlling the regeneration of the particulate collection device 32. A combination of passive and active regeneration may be utilized, if desired.

Exhaust aftertreatment device 34 may receive exhaust from turbine 30 and trap or convert particular constituents in the gas stream. In one example, exhaust aftertreatment device 34 may embody a selective catalytic reduction (SCR) device having a catalyst substrate located downstream from a reductant injector. A gaseous or liquid reductant, most commonly urea, or a water and urea mixture, may be sprayed or otherwise advanced into the exhaust upstream of catalyst substrate by a reductant injector. As the reductant is absorbed onto the surface of catalyst substrate, the reductant may react with NOx (NO and NO2) in the exhaust gas to form water (H2O) and elemental nitrogen (N2). In some embodiments, a hydrolysis catalyst may be associated with catalyst substrate to promote even distribution and conversion of urea to ammonia (NH3).

In accordance with other implementations of the present disclosure, the reduction process may also include an oxidation catalyst, which, for example, may include a porous ceramic honeycomb structure or a metal mesh substrate coated with a material, for example a precious metal, that catalyzes a chemical reaction to alter the composition of the exhaust. For example, the oxidation catalyst may include platinum that facilitates the conversion of NO to NO2, and/or vanadium that suppresses the conversion.

The exhaust aftertreatment device 34 may require desulphation to maintain an acceptable NOx conversion rate. Similar to a regeneration event of the particulate collection device 32, the desulphation event may require increased exhaust temperatures. Decoupling an intake valve actuation (IVA) control from the EGR control during desulphation, for example, may provide enhanced capability for thermal management of the exhaust during such maintenance events.

As described herein, various adjustable parameters associated with exhaust system 18 may be optimized according to an optimization process. For example, an optimization process may be iteratively performed to optimize an open area of an exhaust backpressure valve (e.g., by adjusting a position of a backpressure valve of exhaust system 18), a mass flow through particulate collection device 32 (e.g., by performing active and/or passive regeneration via particulate collection device 32), a pressure of the exhaust gases (e.g., by adjusting a temperature and/or a pressure in the exhaust downstream from turbine 30), and/or the like.

EGR system 20 may redirect gases from exhaust system 18 back into air induction system 16 for subsequent combustion. EGR is a process whereby exhaust gas from the engine is recirculated back into air induction system 16 for subsequent combustion. The recirculated exhaust gases may reduce the concentration of oxygen within the combustion chambers, and simultaneously lower the maximum combustion temperature therein. The reduced oxygen levels may provide fewer opportunities for chemical reaction with the nitrogen present, and the lower temperature may slow the chemical process that results in the formation of NOx. As mentioned above, a cooler may be included to cool the exhaust gases before the gases are combusted.

When utilizing EGR in a turbocharged diesel engine, as shown in FIG. 1, the exhaust gas to be recirculated may be removed upstream of the exhaust gas driven turbine 30 associated with the turbocharger. For example, in many EGR applications, the exhaust gas may be diverted from the exhaust passageway 28 and diverted via an EGR conduit 38 to air induction system 16. Likewise, the recirculated exhaust gas may be re-introduced to the air induction system 16 downstream of the compressor 24. In some implementations, EGR system 20 may be an external EGR system and/or may include various features for implementation of the methods described herein, such as a system of primary control and bypass valves to allow an engine control module (ECM) 40 to control various flows through the EGR system during selected engine operating conditions.

As described herein, various adjustable parameters associated with EGR system 20 may be optimized according to an optimization process. For example, an optimization process may be iteratively performed to optimize a mass flow of exhaust gas through EGR system 20 (e.g., by adjusting an EGR bypass valve and/or the like connected to EGR conduit 38), and/or the like.

Furthermore, as described herein, an optimization process may be calibrated (e.g., configured) to be optimized according to calibration information that identifies one or more operating characteristics associated with operating power system 10. For example, the optimization process may iteratively be performed to determine optimized values associated with the various adjustable parameters to permit the operating characteristic of power system 10 to be optimized. Such operating characteristics may include an expected life span and/or usage rate associated with the power system 10, a performance characteristic associated with the power system 10, or a cost (e.g., a financial cost associated with consumable resources used to operate a power system, a time cost associated with operating the machine and/or maintaining the machine, and/or the like) associated with operating power system 10.

Power system 10 of FIG. 1 includes an ECM 40. ECM 40, as described herein, provides control of power system 10 in order to optimize a plurality of adjustable parameters of power system 10 based on engine operating conditions as indicated by a sensor system 42 and calibration information as indicated by a calibration system 44. ECM 40 is implemented as a processor, such as a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. The processor is implemented in hardware, firmware, and/or a combination of hardware and software. In some implementations, ECM 40 includes one or more processors capable of being programmed to perform a function. In some implementations, one or more memories, including a random-access memory (RAM), a read only memory (ROM), and/or another type of dynamic or static storage device (e.g., a flash memory, a magnetic memory, and/or an optical memory) may store information and/or instructions for use by ECM 40. In some implementations, ECM 40 may include a memory (e.g., a non-transitory computer-readable medium) capable of storing instructions, that when executed, cause the processor to perform one or more processes and/or methods described herein.

ECM 40 may execute the instructions to perform various control functions and processes to control power system 10 and to automatically adjust adjustable parameters of power system 10. ECM 40 may include any appropriate type of engine control system configured to perform engine control functions such that power system 10 may operate properly. Further, ECM 40 may also control another system of a vehicle or machine, such as a transmission system, a hydraulics system, and/or the like.

Sensor system 42 may provide measurements associated with various parameters used by ECM 40 to control power system 10 and/or to determine optimized values for one or more adjustable parameters of power system 10. Sensor system 42 may include physical sensors and/or any appropriate type of control system that generates values of sensing parameters based on a computational model and/or one or more measured parameters. As used herein, sensing parameters may refer to those measurement parameters that are directly measured and/or estimated by one or more sensors (e.g., physical sensors, virtual sensors, and/or the like).

Example sensors may include temperature sensors, speed sensors, chemical composition sensors (e.g., a NOx emission sensor), pressure sensors, and/or the like. Sensing parameters may also include any output parameters that may be measured indirectly by physical sensors and/or calculated based on readings of physical sensors. Measurements from the sensing parameters, as used herein, may refer to any values relevant to the sensing parameters and indicative of the state of the power system 10. For example, measurements may include machine and environmental parameters, such as compression ratios, turbocharger efficiency, after cooler characteristics, temperature values, pressure values, ambient conditions, fuel rates, engine speeds, and/or the like. Measurements may be included as inputs to be provided to one or more virtual sensors.

Sensor system 42 may be configured to coincide with ECM 40, may be configured as a separate control system, and/or may be configured as a part of other control systems. Further, ECM 40 may implement sensor system 42 by using computer software, hardware, or a combination of software and hardware. For example, ECM 40 may execute instructions to cause sensors of sensor system 42 to sense and/or generate values of sensing parameters based on an optimization model and/or other parameters.

Calibration system 44 may provide calibration information associated with optimizing one or more operating characteristics of power system 10. Accordingly, ECM 40 may use the calibration information to control power system 10 and/or determine optimized values for one or more adjustable parameters of power system 10. Calibration system 44 may include one or more calibration devices that determine and/or provide calibration information associated with optimizing the one or more operating characteristics of power system 10. As used herein, the calibration information may include a user preference (e.g., received via a user input), one or more variables associated with the one or more operating characteristics, and or the like. Example calibration devices may include a user device, a user interface of the user device, a user interface tool (e.g., an external tool, an onboard diagnostic tool, and/or the like), a calibration information platform (e.g., a web-based platform that provides calibration information), and/or the like. An operating characteristic that is to be optimized may include one or more of a usage rate associated with power system 10, a performance characteristic associated with power system 10, a cost associated with operating power system 10, and/or the like.

Calibration system 44 may be configured to coincide with ECM 40, may be configured as a separate control system, and/or may be configured as a part of other control systems. Further, ECM 40 may at least partially implement calibration system 44 by using computer software, hardware, or a combination of software and hardware. For example, ECM 40 may execute instructions to cause calibration devices of calibration system 44 to obtain calibration information based on an optimization model and/or other parameters.

In operation, computer software instructions may be stored in or loaded to ECM 40. ECM 40 may execute the computer software instructions to perform various control functions and processes to control power system 10 and to automatically adjust engine operational parameters, such as fuel injection timing and fuel injection pressure, one or more operational temperatures, one or more mass flows, and/or the like. Additionally, or alternatively, ECM 40 may execute computer software instructions to generate and/or operate sensor system 42 to provide engine temperature values, engine pressure values, engine emission values, engine speed values, actuator or valve position values, and/or other parameter values used to monitor and/or control power system 10.

ECM 40 may also identify, obtain, and/or determine parameters that are associated with conditions (e.g., as sensed by sensor system 42) or settings corresponding to the operations of power system 10, such as engine speed, fuel rate or quantity, injection timing, intake manifold temperature (IMAT), intake manifold pressure (IMAP), intake valve actuation (IVA) end of current, IVA timing, intake throttle valve position, injection air pressure, injection fuel pressure, torque delivered by the engine, total fuel injection quantity, exhaust pressure, number of cylinders 14 firing, oxygen/fuel molar ratio, ambient temperature, ambient pressure (e.g., barometric pressure), mass flow through particulate collection device 32, exhaust backpressure valve position, shot mode, coolant temperature, total induction mass flow in multi-shot mode, dwell (e.g., length of time between shots) in multi-shot mode, and/or the like. The non-adjustable parameters may be measured by certain physical sensors, such as a high precision lab grade physical sensor, or created by other control systems.

As indicated above, FIG. 1 is provided as an example. Other examples may differ from what is described in connection with FIG. 1.

Figure 2:
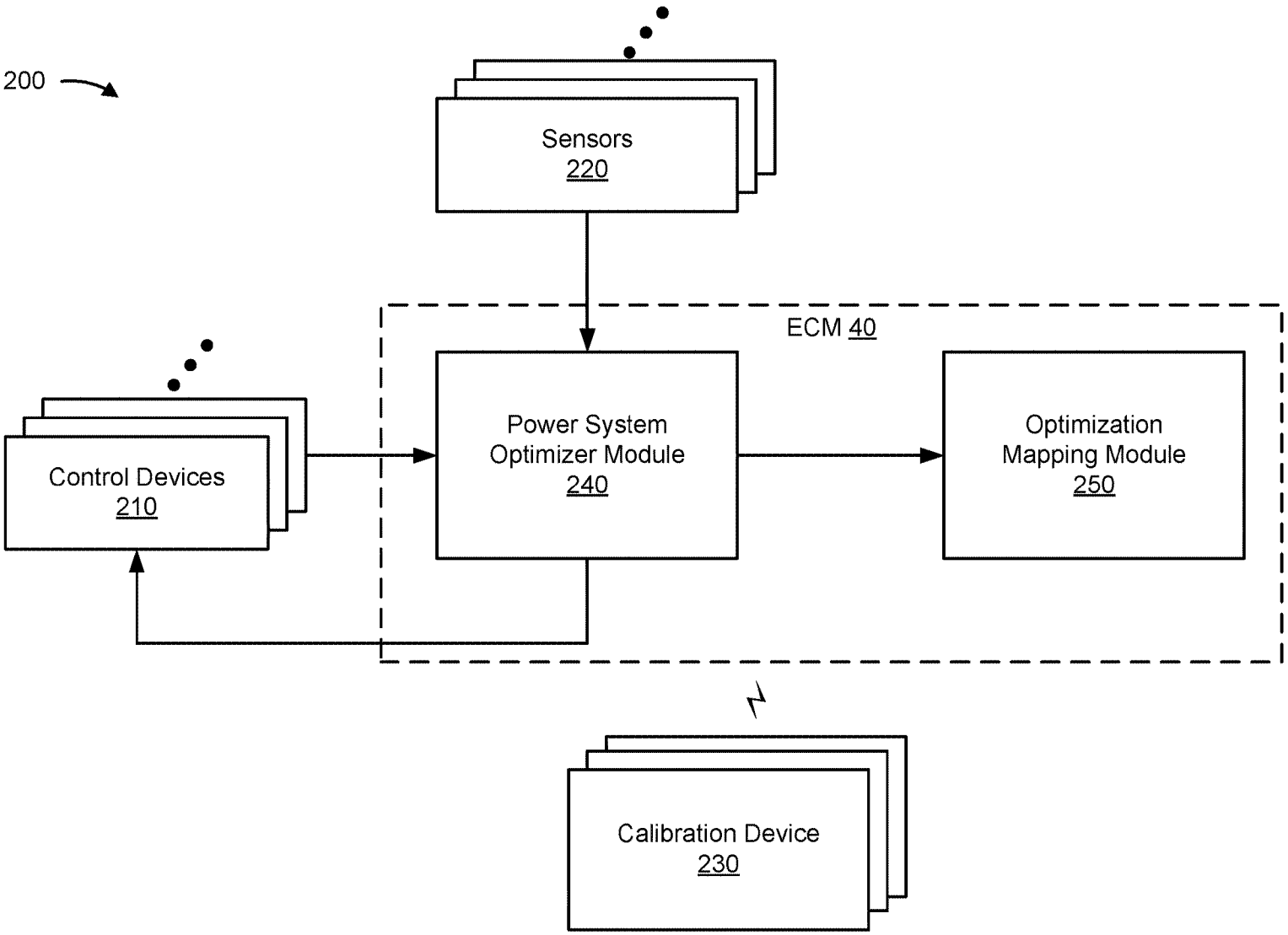
FIG. 2 is a diagram of an example optimization system in which systems and/or methods described herein may be implemented.

FIG. 2 is a diagram of an example optimization system 200 in which systems and/or methods described herein may be implemented. As shown in FIG. 2, optimization system 200 may include one or more control devices 210 (referred to individually as "control device 210" and collectively as "control devices 210"), one or more sensors 220 (referred to individually as "sensor 220" and collectively as "sensors 220"), one or more calibration devices 230 (referred to individually as "calibration device 230" and collectively as "calibration devices 230"), and ECM 40. As shown in FIG. 2, ECM 40 may include a power system optimizer module 240 and an optimization mapping module 250. ECM 40 of FIG. 2 may correspond to ECM 40 of FIG. 1. Devices and/or components of optimization system 200 may interconnect via wired connections, wireless connections, or a combination of wired and wireless connections.

Control device 210 may be any type of device that may be used by ECM 40 to control a performance feature of power system 10. For example, control device 210 may include one or more actuators, switches, and/or the like that are capable of opening and/or closing a valve within power system 10, adjusting a temperature within power system 10 (e.g., using a fan, a cooling system, and/or the like), adjusting a pressure within power system 10, and/or the like.

Control device 210 may be associated with one or more adjustable parameters that may be optimized via an optimization process, as described herein. For example, a value of the adjustable parameter for control device 210 may represent or indicate a setting of the control device 210, such as a position of an actuator, a length of time that a valve is open, a position of the valve, a temperature at which to operate, a pressure at which to compress air and/or fuel, and/or the like.

Sensors 220 may include any type of sensor configured to measure operating conditions of power system 10. Sensors 220 may be sensors of sensor system 42, as described herein. For example, the sensors 220 may include temperature sensors (e.g., to detect temperature of air, exhaust, a component, coolant, and/or the like), position sensors (e.g., to detect a position of a valve, an actuator, an engine part (e.g., a piston), and/or the like), speed sensors (e.g., to detect an engine speed, a machine speed, and/or the like), pressure sensors (e.g., to detect a measure of compression of air or exhaust in power system 10), emissions sensors (e.g., to detect emission levels of power system 10), and/or the like.

Sensor 220 may be associated with one or more sensing parameters that may be used in optimizing values for adjustable parameters of control device 210 via an optimization process, as described herein. For example, a value of the sensing parameter for sensor 220 may represent or indicate a measurement of the sensor 220, such as a measured temperature by a temperature sensor, a measured timing of a valve opening and/or closing by a position sensor, a measured speed of an engine by a speed sensor, a measured position of an actuator by a position sensor, measured emissions by an emissions sensor, and/or the like.

Calibration devices 230 may include any type of device, system, and/or platform configured to provide calibration information associated with operating power system 10. Calibration devices 230 may be and/or may include calibration devices of calibration system 44, as described herein. For example, calibration devices 230 may include a user device, a user interface of a user device, a user interface tool configured to communicate with ECM 40, one or more platforms configured to provide calibration information to ECM 40, and/or the like.

In some implementations, calibration device 230 may include an onboard user interface (e.g., a user interface of an operator station, a user interface tool, and/or the like) associated with a machine that is associated with optimization system 200. In such cases, a user may be configured to provide calibration information from the onboard user interface of the machine. Additionally, or alternatively, one or more calibration devices 230 shown in FIG. 2 may be remotely located from the machine that includes one or more remaining devices of optimization system 200. For example, the machine may be a machine under operation at a work site. In such an example, ECM 40, control devices 210, and/or sensors 220 may be located on or near the machine and one or more calibration devices 230 may be partially or entirely remotely located in a device (e.g., a server device) of a control station of the work site and/or in a device of a remote office associated with an organization that operates the work site.

In some implementations, calibration device 230 may track and/or provide information associated with operating characteristics that are to be optimized as described herein. For example, if ECM 40 is to optimize a usage rate (e.g., to enhance to and/or extend a life expectancy or life span associated with power system 10), calibration device 230 may provide and/or maintain information about the usage of power system 10. For example, calibration information (e.g., received via a user input) may indicate that a usage rate is to be optimized. The usage rate may be optimized to follow a particular maintenance schedule and/or to extend a life expectancy of power system 10 and/or a machine associated with power system 10. In some implementations, historical information associated with the usage rate and/or factors that are to be considered in extending the life of power system 10 may be received via calibration devices 230.

In some implementations, one or more performance characteristics (e.g., a speed (e.g., an engine speed, a machine speed, and/or the like), supplied torque, fuel consumption, emissions, and/or the like) may be optimized, as described herein. The one or more performance characteristics may be identified in the calibration information (e.g., as a user input) and/or information associated with the performance of the vehicle may be provided to ECM 40 by calibration devices 230 (e.g., via results of tests and/or analyses of performance of power system 10 that was performed by calibration devices 230, such as work site monitoring systems and/or platforms).

In some implementations, calibration device 230 may include one or more platforms that provide calibration information associated with one or more variables of one or more operating characteristics of power system 10. For example, when an operating characteristic associated with a cost (e.g., a financial cost associated with consumable resources used to operate a power system, a time cost associated with operating the machine and/or maintaining the machine, and/or the like) is to be optimized, ECM 40 may be configured to receive calibration information from a calibration device 230 that is configured to provide cost information associated with a consumable resource, a cost associated with downtime of the machine, a cost associated with a human operating the machine, and/or the like. As a more specific example, ECM 40 may be configured to receive a really simple syndication (RSS) feed that provides a cost of the consumable resource (or an average cost of fuel) at a particular location (e.g., in a particular region, county, state, country, and/or the like). In such cases, ECM 40 may be registered with the calibration device 230 to permit the calibration device 230 to provide the information to ECM 40. Therefore, ECM 40 may receive information on a cost of fuel, DEF, and/or the like at the particular location. Additionally, or alternatively, ECM 40 may receive information associated with a budget for operating power system 10 and/or a machine associated with power system 10. In some implementations, ECM 40 may be configured to automatically optimize one operating characteristic over another based on the calibration information. For example, if ECM 40 is configured to optimize performance (e.g., for maximum speed and/or torque output) but not to exceed a budget to operate power system 10, and ECM 40 receives calibration information that indicates (or describes) that the budget could be exceeded if optimizing performance continues (e.g., due to an increase in fuel prices), ECM 40 may automatically configure an optimization model to determine optimization parameters to optimize cost associated with operating power system 10 and/or to optimize performance of power system 10 without exceeding the budget.

Other examples of calibration devices 230 may include a platform configured to provide weather information (e.g., to permit the power system optimizer module 240 to determined optimized values associated with the weather), a platform configured to provide regulation information (e.g., to permit the power system optimizer module 240 to ensure that power system 10 is conforming to certain regulations and/or laws (e.g., associated with emissions)), and/or the like. For example, given an update to an emissions level regulation in a particular jurisdiction (e.g., a state, a country, and/or the like), the platform may provide the updated emissions level to the ECM 40 to permit power system optimizer module 240 to optimize performance of power system 10 while meeting the updated emissions level. Additionally, or alternatively, a user may provide, via calibration device 230, a user input to meet and/or achieve a lower emissions level than the emissions level regulation of a particular jurisdiction.

Accordingly, calibration device 230 may be associated with calibration information that may be used in optimizing an operating characteristic of power system 10, as described herein. For example, the calibration information associated with calibration device 230 may represent or indicate an input, to ECM 40, from the calibration device 230. For example, the input and/or the information may include one or more of a user input (e.g., a user input that identifies the operating characteristic that is to be optimized), a variable associated with the operating characteristic that is to be optimized, and/or the like.

Power system optimizer module 240 may include one or more devices configured to perform an optimization process to identify optimized operational settings for control devices 210. The optimized operational settings for control device 210 may be determined according to calibration information associated with optimizing one or more operating characteristics of power system 10 as described herein. As shown, power system optimizer module 240 may be included within and/or implemented by ECM 40. As described herein, power system optimizer module 240 may be configured to determine the optimized operational settings for control devices 210 and to include the optimized operational settings in an optimization profile according to calibration information received from calibration devices 230.

In some implementations, power system optimizer module 240 may include and/or utilize an optimization model. The optimization model may be configured to perform one or more optimization processes as described herein. In some implementations, the optimization model may perform the one or more optimization processes according to calibration information received from calibration devices 230.

In some implementations, one or more optimization processes performed by power system optimizer module 240 (e.g., by an optimization model associated with power system optimizer module 240) may be configured via a user interface and/or default settings to identify adjustable parameters of power system 10 and optimize values for various sets or various numbers of adjustable parameters of power system 10 using one or more optimization processes. For example, in some implementations, a user and/or manufacturer (e.g., a manufacturer of power system 10) may configure power system optimizer module 240 to optimize multiple sets of adjustable parameters of power system 10 via optimization processes, as described herein.

Power system optimizer module 240, according to some implementations described herein, is configured to identify a plurality of adjustable parameters to control power system 10 to optimize an operating characteristic associated with power system 10. For example, power system optimizer module 240 may identify the plurality of adjustable parameters based on which control devices 210 are included within optimization system 200 and/or which control devices 210 are configurable via ECM 40. Additionally, or alternatively, power system optimizer module 240 may identify a plurality of sensing parameters (e.g., non-adjustable parameters) associated with power system 10. For example, power system optimizer module 240 may identify the plurality of sensing parameters based on which sensors 220 are included within optimization system 200 and/or which sensors 220 provide measurements to ECM 40.

In some implementations, power system optimizer module 240 determines that a set of adjustable parameters is to be optimized according to an optimization process. The set of adjustable parameters may include one or more parameters of the plurality of adjustable parameters that are associated with one or more control devices 210. The set of adjustable parameters may be designated for optimization according to a configuration of optimization system 200, as provided by a user and/or a manufacturer. For example, a user and/or manufacturer may designate one or more adjustable parameters to be optimized during operation of power system 10. In such cases, the user and/or manufacturer may assign an optimization characteristic (e.g., a flag and/or identifier indicating that the adjustable parameter is to be optimized) to the adjustable parameters indicating that the adjustable parameters are to be optimized during operation and/or at particular times relative to other adjustable parameters (e.g., after one or more adjustable parameters are optimized).

In some implementations, one or more adjustable parameters are to be adjusted to be optimized, such that the optimized adjustable parameters optimize one or more operating characteristics of power system 10. Accordingly, based on receiving calibration information associated with optimizing the one or more operating characteristics of power system 10, power system optimizer module 240 may identify corresponding adjustable parameters that are to be optimized, according to the calibration information, and assign optimization characteristics to the one or more adjustable parameters to cause the one or more optimization processes to optimize the one or more adjustable parameters accordingly. Therefore, the power system optimizer module 240 may perform the one or more optimization processes to determine optimized values associated with the adjustable parameters based on the designated optimization characteristics.

In some implementations, the user and/or manufacturer may indicate a priority of optimizing the adjustable parameters according to the calibration information. For example, the optimization characteristic may describe different priorities of when or how the adjustable parameters are to be optimized. In some implementations, the adjustable parameters may be assigned to tiers. For example, based on the calibration information, certain operating characteristics may cause certain adjustable parameters to be assigned to one tier and other operating characteristics may cause the certain adjustable parameters to be assigned to a different tier.

In some implementations, first tier adjustable parameters may be optimized according to a first optimization process, second tier adjustable parameters may be optimized according to a second optimization process that takes place after the first optimization process, third tier adjustable parameters may be optimized according to a third optimization process that takes place after the second optimization process, and so on. In some implementations, an optimization characteristic may indicate that one or more adjustable parameters are to always be optimized when a particular operating characteristic is to be optimized as described herein. In such cases, the one or more adjustable parameters may be included in all sets of adjustable parameters that are optimized according to the different optimization processes (e.g., the first, second, and third optimization processes).

As a specific example, a first identifier (e.g., which can be represented by a "1" or similar priority indicating identifier) can be assigned to designate first tier adjustable parameters that are to always be optimized, a second identifier (e.g., which can be represented by a "2" or similar priority indicating identifier) can be assigned to designate second tier adjustable parameters that are to be optimized via an initial optimization process with the first tier adjustable parameters, and a third identifier (e.g., which can be represented by a "3" or similar priority indicating identifier) can be assigned to designate third tier adjustable parameters that may be optimized after the initial optimization process along with the first tier adjustable parameters and/or the second tier adjustable parameters.

According to some implementations, for a particular operating characteristic that is to be optimized, the first tier of adjustable parameters are to always be optimized, the second tier of adjustable parameters are to be optimized along with the first tier of adjustable parameters using a first optimization process (e.g., to find the optimized value of the first tier of adjustable parameters while optimizing the second tier of adjustable parameters), and the third tier of adjustable parameters may be optimized, once the optimized values for the first tier of adjustable parameters and the second tier of adjustable parameters are found, using a second optimization process. As an example, if cost of fuel is to be optimized, to limit fuel consumption, a first tier of adjustable parameters may include total fuel quantity injected into the combustion chamber; a second tier of adjustable parameters may include timing of injecting the fuel (e.g., a unit of degrees from top dead center of cylinders 14) and EGR mass flow; and a third tier of adjustable parameters may include an air pressure of air when injected into the combustion chamber, a fuel pressure of fuel when injected into the combustion chamber, a temperature at an outlet of an air cooler of air induction system 16, a number of cylinders 14 that are to fire, and/or a shot mode corresponding to a number of shots (injections) of fuel per revolution of the pistons of the cylinders 14. In such an example, the total fuel quantity injected, the timing of injecting the fuel, and the EGR mass flow may be optimized via a first optimization process. For a second, subsequent optimization process, power system optimizer module 240 may optimize the total fuel quantity injected and select (e.g., randomly, semi-randomly, and/or according to a priority) a set of parameters (e.g., a threshold number of parameters) that are to be optimized from the timing of injecting the fuel, EGR mass flow, air pressure, fuel pressure, temperature at the outlet of the air cooler, number of cylinders 14 that are to fire, and/or shot mode.

In some implementations, power system optimizer module 240 may select adjustable parameters that are to be optimized from a set of adjustable parameters that are designated to be optimized based on the calibration information from calibration devices 230. In some implementations, power system optimizer module 240 may be configured to optimize a maximum of a threshold number (e.g., four or less) of parameters using a single optimization process. Therefore, if power system optimizer module 240 determines that more than the threshold number of adjustable parameters are to be optimized according to a particular priority or tier of the adjustable parameters (which may be determined based on the calibration information), power system optimizer module 240 may select the threshold number of adjustable parameters to be the set of adjustable parameters that are to be optimized. Power system optimizer module 240 may select the set of adjustable parameters randomly and/or according to one or more priority characteristics associated with each of the adjustable parameters (e.g., priority characteristics that are assigned based on which operating characteristic is to be optimized). In some implementations, each time that parameters are to be selected for optimization, a similar selection process or a different selection process can be used to select the parameters. For example, each selection can be random, semi-random, and/or selected according to a same priority scheme. As described herein, the parameters may be selected based on an indication of an operating characteristic of power system 10 that is to be optimized according to the calibration information.

The optimization process performed by power system optimizer module 240 may be any suitable optimization process that calculates optimized values for an adjustable parameter based on the values of other remaining adjustable parameters associated with control devices 210 and values of sensing parameters associated with sensors 220. For example, the optimization process may include a process that adjusts one or more values of the adjustable parameters until an optimized value for the adjustable parameter is found. The optimization process may include a semi-random assignment of values for the adjustable parameters (e.g., using a gradient based optimization method, a non-gradient based optimization method, a combination of a gradient based optimization method and non-gradient based optimization method, and/or the like), an optimization model that determines the performance of the engine of power system 10 with settings and/or measurements from the control devices 210 and sensors 220, and/or a cost function that defines a certain performance for the engine of power system 10 (e.g., based on one or more weighting factors, performance, constraints, and/or the like). In some implementations, a weighting factor may be determined based on the operating characteristic that is to be optimized according to the calibration information.

Using the optimization process, the power system optimizer module 240 may determine an optimized value for an adjustable parameter of a control device 210 by finding a minimum cost function value (according to particular weights of the cost function for particular parameters) achieved according to an optimization process using settings of control devices 210 and/or operating conditions of power system 10 as sensed by sensors 220.

In some implementations, ECM 40 may have a designated set of resources to run the power system optimizer module 240 to determine optimized values for optimization system 200. For example, to perform an optimization process, ECM 40 may only be able to iteratively make a threshold number of calculations of the optimization process within a particular period of time. For example, ECM 40 may be configured to optimize settings of one or more control devices every threshold period of time or a limited period of time (e.g., every 60 milliseconds (ms), every 120 ms, every 400 ms, and/or the like). Accordingly, as an example, ECM 40 may perform an optimization process every 400 ms, allowing a threshold number of calculations or a limited number of calculations (e.g., 200 calculations, 400 calculations, 1000 calculations, and/or the like based on converging adjustments to values of the parameters that are to be optimized) to be made during that time period to perform the optimization process to optimize corresponding performance features of power system 10 (e.g., by adjusting settings of control devices 210 to optimized values found by performing the optimization process). Therefore, the greater the number of adjustable parameters that are to be adjusted during a given optimization process, the less dense the sample for optimizing each adjustable parameter, and the less likely it is that an identified optimized value, for each of the adjustable parameters that are being optimized, can be found. Accordingly, power system optimizer module 240 iteratively performs the optimization process for the threshold number adjustable parameters (e.g., to optimize a limited number (e.g., four or less) rather than all parameters every 400 ms) before attempting to optimize additional parameters.

Therefore, according to some implementations, power system optimizer module 240 may iteratively perform an optimization process until a set of adjustable parameters is optimized according to the optimization process. The set of adjustable parameters may be optimized according to the optimization process once all parameters of the set of adjustable parameters are optimized, once a threshold number of parameters of the set of adjustable parameters are optimized, once a threshold percentage of the set of adjustable parameters are optimized, once at least a particular parameter, in the set of adjustable parameters, is optimized, and/or the like. Furthermore, the set of adjustable parameters may be optimized according to the optimization process after a threshold number of iterations (e.g., three iterations, five iterations, and/or the like) of performing the optimization process result in the same or similar (e.g., within a tolerance) corresponding values for all parameters of the set of adjustable parameters, for a threshold number of parameters of the set of adjustable parameters, for a threshold percentage of the set of adjustable parameters, for at least a particular parameter in the set of adjustable parameters, and/or the like.

Referring back to the example above, power system optimizer module 240 may iteratively make 1000 calculations, every 400 ms, using values of the sensing parameters, current settings, or null values for adjustable parameters that are not being optimized, and adjusted values (e.g., randomly adjusted, and/or semi-randomly adjusted) for each calculation according to results of previous calculations, until the optimization process repeatedly finds the same values for the adjustable parameters that are to be optimized for that set of adjustable parameters (or that the adjustable parameters fall within a range). For example, after three iterations of an optimization process, five iterations of the optimization process, and/or the like, power system optimizer module 240 may determine that the optimized values for the adjustable parameters have been found by that optimization process. In some implementations, the number of iterations to determine that the optimization has been found may be based on the optimization process that is being performed. For example, an initial optimization process to optimize a first set of adjustable parameters may require at least five iterations of the initial optimization process to find the same values for the first set of adjustable parameters in order to determine that those same values are optimized values for the first set of adjustable parameters according to the initial optimization process. Additionally, or alternatively, a subsequent optimization process to optimize a second set of adjustable parameters may require more iterations and/or fewer iterations (e.g., four iterations or less) of the subsequent optimization process in order to find the same values for the set of adjustable parameters and to determine that those same values are optimized values for the second set of adjustable parameters according to the subsequent optimization process. Therefore, if power system optimizer module 240 determines that a same value is found for a set of adjustable parameters that are to be optimized after a threshold number of iterations of the optimization process (e.g., after three or more iterations of the optimization process), power system optimizer module 240 may determine that the optimized values for the set of adjustable parameters has been found.

Once optimized values are found or determined for the set of adjustable parameters that are to be optimized for a particular operating characteristic of power system 10, power system optimizer module 240 may select a subsequent set of adjustable parameters of the plurality of adjustable parameters to be optimized according to a subsequent optimization process to optimize the particular operating characteristic of power system 10. The subsequent optimization process may be the same type of optimization process as previously performed (e.g., 1000 calculations every 400 ms, 200 calculations every 60 ms, and/or the like) or a different type of optimization process that optimizes values for one or more adjustable parameters that have been optimized according to the previous optimization process, according to measured values for sensing parameters of sensors 220, according to current settings for adjustable parameters of control devices 210 that are not being optimized, and/or according to adjusted values for adjustable parameters of control devices 210 that are to be optimized. Power system optimizer module 240 may iteratively perform the subsequent optimization process until the subsequent set of parameters are optimized according to the second optimization process. In some implementations, the previously optimized parameters may remain optimized because optimized values are set (e.g., according to optimization mapping module 250) for those parameters during the iterative performance of the second optimization process. Additionally, or alternatively, one or more parameters that were optimized by the previous optimization process may again be designated or selected to be optimized during the subsequent optimization process. Furthermore, once all parameters, a threshold number of parameters, a threshold percentage of parameters, a particular parameter, and/or the like of the subsequent set of parameters that are to be optimized are optimized, power system optimizer module 240 may select a third set of parameters that are to be optimized, and a third optimization process may similarly be iteratively performed, and so on. In such cases, the optimization processes may be a same type of optimization process. For example, the optimization processes may use a similar type of sampling, a similar number of samples, a similar type of execution process (e.g., a same type of algorithm), and/or the like. Additionally, or alternatively, the optimization process may use different optimization processes when optimizing different sets of optimization parameters. In such cases, the optimization process may use a different type of sampling, a different number of samples, a different type of execution process, and/or the like.

Once optimized values are found (e.g., after the optimization process finds a same optimized value after a threshold number of iterations of executing the optimization process), power system optimizer module 240 may set optimized values in an optimization profile (e.g., which may be stored or maintained in optimization mapping module 250) for the adjustable parameters that were optimized according to the optimization process that was performed to optimize the operating characteristic of power system 10. Accordingly, using the example described above, after optimized values are found following iterative executions of an initial optimization process, the optimized values may be set, in an optimization profile in optimization mapping module, for the set of adjustable parameters that were optimized by the initial optimization process. Furthermore, after the set of adjustable parameters and the subsequent set of adjustable parameters are optimized following iteratively performing the subsequent optimization process, the optimized values may be set in the optimization profile in the optimization mapping module 250.

Optimization mapping module 250 may be any suitable data structure (e.g., a database, a table, an index, a graph, and/or the like) that may store optimized values for adjustable parameters associated with control devices 210. In some implementations, power system optimizer module 240 may obtain and/or use optimized values in an optimization profile, of optimization mapping module 250, to perform optimization processes as described herein. For example, optimized values in the optimization mapping module 250 may be used as input values for one or more adjustable parameters for the control devices when performing an optimization process.

In some implementations, optimization mapping module 250 includes a plurality of tables, mappings, and/or the like that correspond to a variety of measurements associated with sensors 220 and/or settings associated with control devices 210. Accordingly, depending on the environmental characteristics of power system 10, different mappings may be used to perform an optimization process. Additionally, or alternatively, optimization mapping module 250 may include a plurality of optimization profiles that correspond to a variety of optimized values determined to optimize an operating characteristic of power system 10 as described herein. In some implementations, power system optimizer module 240 may use a machine learning model (e.g., the optimization model) to determine optimized values to optimize one or more operating characteristics of power system 10. For example, power system optimizer module 240 may train the machine learning model based on one or more parameters associated with performing the optimization processes to determine the optimized values for the adjustable parameters to optimize the one or more operating characteristics, such as measurement values from sensors 220, usage of power system 10 (e.g., total hours of use, usage history, and/or the like), one or more variables associated with operating power system 10 (e.g., financial costs, human resources costs, time costs, and/or the like), one more characteristics of a machine or uses of the machine associated with power system 10 (e.g., one or more tasks that are to be used by the machine), and/or the like. Power system optimizer module 240 may train the machine learning model, according to the one or more parameters, using historical data associated with determining optimized values associated with adjustable parameters to optimize the one or more operating characteristics for power system 10, one or more other power systems that optimize the one or more operating characteristics (e.g., based on previous optimization profiles that include optimized values for the one or more adjustable parameters). Using the historical data and the one or more parameters as inputs to the machine learning model, power system optimizer module 240 may determine optimized values for one or more adjustable parameters to optimize an operating characteristic according to calibration information received from calibration device 230. In some implementations, power system optimizer module 240 may receive and/or use an optimization model that has already been trained according to the above parameters or other parameters.

According to some implementations, power system optimizer module 240 may update optimized values for an adjustable parameter when an optimization process finds an optimization value for the adjustable parameter that is less than or greater than the optimization value in an optimization profile to optimize a particular operating characteristic of power system 10 (depending on whether the adjustable parameter has a minimum optimized value or a maximum optimized value). Therefore, optimization mapping module 250 may be dynamically updated after each optimization process is executed and/or after a threshold number of iterations finds the same or similar values for adjustable parameters that are to be optimized according to the optimization process.

In some implementations, ECM 40 may use optimized values in an optimization profile of optimization mapping module 250 to configure settings of control device 210 during operation of optimization system 200 and/or power system 10. For example, ECM 40 may instruct control devices 210 to adjust settings of the control devices 210 to use the optimization settings. Accordingly, ECM 40 may dynamically configure control device 210 to be set to optimize performance of power system 10.

The number and arrangement of devices shown in FIG. 2 are provided as an example. In practice, there may be additional devices, fewer devices, different devices, or differently arranged devices than those shown in FIG. 2. Furthermore, two or more devices shown in FIG. 2 may be implemented within a single device, or a single device shown in FIG. 2 may be implemented as multiple, distributed devices. Additionally, or alternatively, a set of devices (e.g., one or more devices) of optimization system 200 may perform one or more functions described as being performed by another set of devices of optimization system 200.

Figure 3:
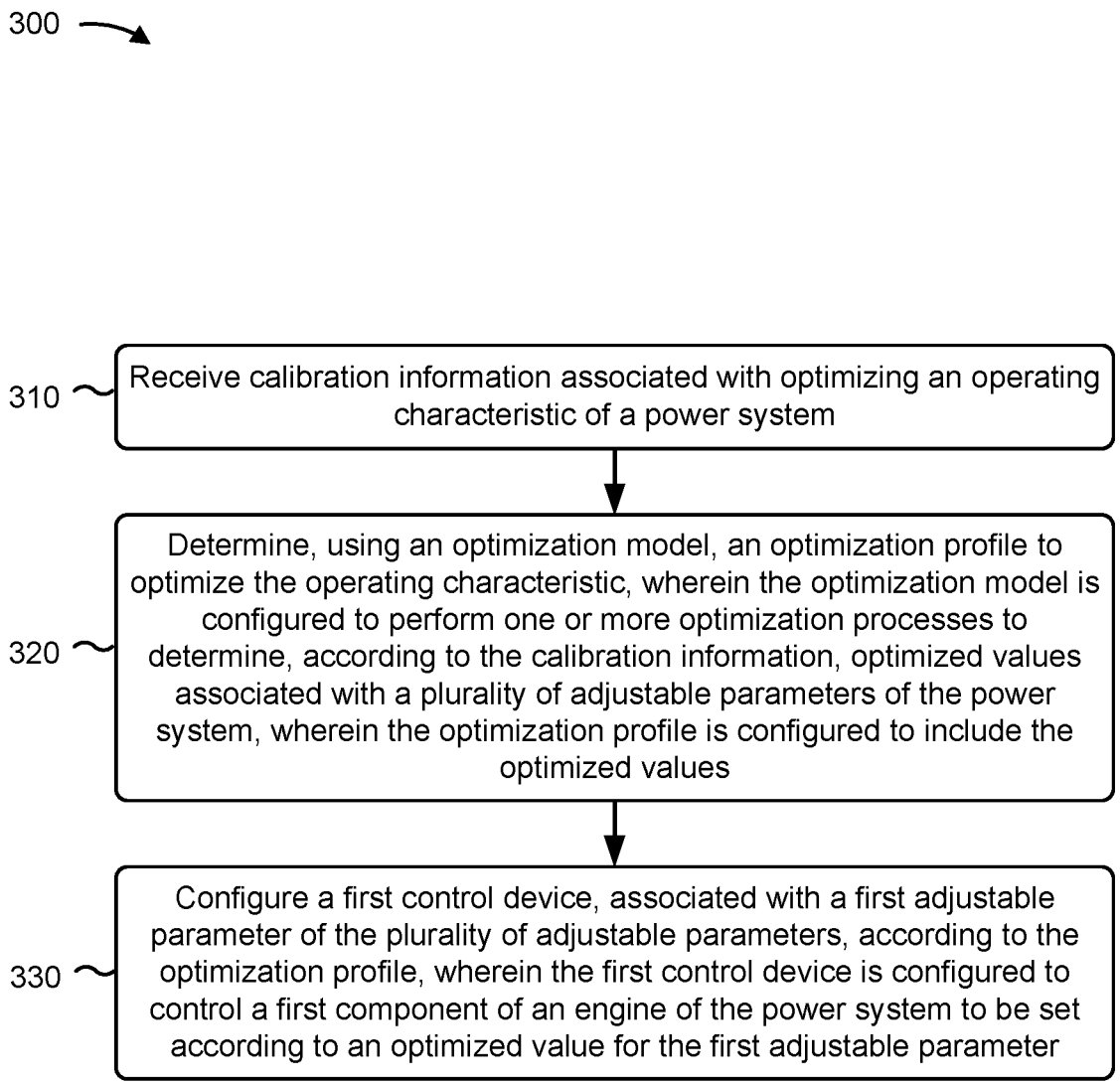
FIG. 3 is a flow chart of an example process associated with power system optimization calibration.

FIG. 3 is a flow chart of an example process 300 associated with power system optimization calibration. In some implementations, one or more process blocks of FIG. 3 may be performed by an ECM (e.g., ECM 40 using power system optimizer module 240 and/or optimization mapping module 250). In some implementations, one or more process blocks of FIG. 3 may be performed by another device or a group of devices separate from or including the ECM, such as control devices (e.g., control devices 210), sensors (e.g., sensors 220), and/or calibration devices 230 of a system (e.g., power system 10 and/or optimization system 200).

As shown in FIG. 3, process 300 may include receiving calibration information associated with optimizing an operating characteristic of a power system (block 310). For example, the ECM (e.g., using power system optimizer module 240) may receive calibration information associated with optimizing an operating characteristic of a power system, as described above.

As further shown in FIG. 3, process 300 may include determining, using an optimization model, an optimization profile to optimize the operating characteristic, wherein the optimization model is configured to perform one or more optimization processes to determine, according to the calibration information, optimized values associated with a plurality of adjustable parameters of the power system, wherein the optimization profile is configured to include the optimized values (block 320). For example, the ECM (e.g., using power system optimizer module 240) may determine, using an optimization model, an optimization profile to optimize the operating characteristic, as described above. In some implementations, the optimization model is configured to perform one or more optimization processes to determine, according to the calibration information, optimized values associated with a plurality of adjustable parameters of the power system. In some implementations, the optimization profile is configured to include the optimized values.

As further shown in FIG. 3, process 300 may include configuring a first control device, associated with a first adjustable parameter of the plurality of adjustable parameters, according to the optimization profile, wherein the first control device is configured to control a first component of an engine of the power system to be set according to an optimized value for the first adjustable parameter (block 330). For example, the ECM (e.g., using power system optimizer module 240) may configure a first control device, associated with a first adjustable parameter of the plurality of adjustable parameters, according to the optimization profile, wherein the first control device is configured to control a first component of an engine of the power system to be set according to an optimized value for the first adjustable parameter, as described above.

Process 300 may include additional implementations, such as any single implementation or any combination of implementations described below and/or in connection with one or more other processes described elsewhere herein.

In some implementations, the calibration information is received, from a user interface, within a user input. In some implementations, the user interface is configured to enable a user to calibrate the power system via the engine control module. In some implementations, the calibration information specifies the operating characteristic to cause the optimization profile to be determined.

In some implementations, the calibration information includes a variable associated with the operating characteristic, and the ECM may determine, based on the variable and before determining the optimization profile, that the operating characteristic is to be optimized.

In some implementations, the optimization model is configured to perform the one or more optimization processes based on measurements received from sensors that monitor the engine.

In some implementations, the optimization model is trained based on historical information associated with the power system optimizing the operating characteristic. In some implementations, the historical information includes previous optimization profiles that include previous optimized values associated with the plurality of adjustable parameters. In some implementations, the previous optimized values were previously used to control the engine.

In some implementations, the ECM may configure a second control device, associated with a second adjustable parameter of the plurality of adjustable parameters, according to the optimization profile. In some implementations, the second control device is configured to control a second component of the power system to be set according to an optimized value for the second adjustable parameter.

Additionally, or alternatively, a process, as described herein, may include receiving calibration information to optimize an operating characteristic associated with operating a power system. For example, the ECM (e.g., using power system optimizer module 240) may use calibration information to optimize an operating characteristic associated with operating a power system, as described above.

Such a process may include determining an optimization profile for operating the power system using an optimization model, wherein the optimization profile is configured to specify optimized values for a plurality of adjustable parameters of the power system, and wherein the optimization model is configured to: iteratively perform one or more optimization processes to determine, according to the one or more optimization processes, potential optimized values for the plurality of adjustable parameters to control the power system, and selectively designate, within the optimization profile and based on the calibration information, respective optimized values, from the potential optimized values, for the plurality of adjustable parameters. For example, the ECM (e.g., using power system optimizer module 240) may determine an optimization profile for operating the power system using an optimization model, as described above. In some implementations, the optimization profile is configured to specify optimized values for a plurality of adjustable parameters of the power system. In some implementations, the optimization model is configured to iteratively perform one or more optimization processes to determine, according to the one or more optimization processes, potential optimized values for the plurality of adjustable parameters to control the power system, and to selectively designate, within the optimization profile and based on the calibration information, respective optimized values, from the potential optimized values, for the plurality of adjustable parameters.

Such a process may include configuring one or more control devices, associated with the plurality of adjustable parameters, according to the optimization profile to control the power system to optimize the operating characteristic. For example, the ECM (e.g., using power system optimizer module 240) may configure one or more control devices, associated with the plurality of adjustable parameters, according to the optimization profile to control the power system to optimize the operating characteristic, as described above.

Such a process may include additional implementations, such as any single implementation or any combination of implementations described below and/or in connection with one or more other processes described herein.

In some implementations, the calibration information is received from at least one of: a user device associated with a machine of the power system, a user interface tool configured to communicate with the engine control module, or an information platform that provides characteristic information associated with the operating characteristic.

In some implementations, the optimization model is trained based on historical information associated with the power system, or one or more other power systems, optimizing the operating characteristic. The historical information may include previous optimization profiles that include previous optimized values associated with the plurality of adjustable parameters. In some implementations, the previous optimized values were previously used to control the power system or the one or more other power systems.

In some implementations, the optimization model is configured to perform the one or more optimization processes based on measurements received from one or more sensors that monitor the power system during operation. The one or more of the measurements indicate whether or not the operating characteristic is being optimized.

In some implementations, the ECM may, when configuring the control devices, set the one or more control devices to control the power system to operate according to respective optimized values associated with the plurality of adjustable parameters identified in the optimization profile.

In some implementations, the power system includes an engine under operation and the plurality of adjustable parameters include at least two of: a quantity of a fuel injected into a cylinder of the engine, a timing of when a fuel is injected into a cylinder of the engine, a pressure of a fuel that is to be injected into a cylinder of the engine, a pressure of air that enters a cylinder, a number of cylinders of the engine that are to receive a fuel during operation, a mass flow of an auxiliary regeneration device of an aftertreatment system of the power system, a position of an exhaust backpressure valve, a position of an intake throttle valve, a shot mode of the engine corresponding to a number of shots of a fuel that are used to inject the fuel into a cylinder, an amount of time between shots of a fuel into a cylinder in a multi-shot mode, or an amount of a fuel per shot in a multi-shot mode.

In some implementations, the operating characteristic includes at least one of: a usage rate associated with the power system, a performance characteristic associated with the power system, or a cost associated with operating the power system.

Additionally, or alternatively, a process, as described herein, may include receiving, from one or more calibration devices, calibration information, wherein the calibration information indicates an operating characteristic of an engine that is to be optimized. For example, the ECM (e.g., using power system optimizer module 240) may receive, from one or more calibration devices, calibration information, as described above. In some implementations, the calibration information indicates an operating characteristic of an engine that is to be optimized.

Such a process may include, based on receiving the calibration information, configuring an optimization model of the engine control module, wherein the optimization model is configured to perform one or more optimization processes, according to the calibration information and based on measurements received from the one or more sensors, to optimize a plurality of adjustable parameters associated with one or more of the one or more control devices. For example, the ECM (e.g., using power system optimizer module 240) may, based on receiving the calibration information, configure an optimization model of the engine control module, as described above. In some implementations, wherein the optimization model is configured to perform one or more optimization processes, according to the calibration information and based on measurements received from the one or more sensors, to optimize a plurality of adjustable parameters associated with one or more of the one or more control devices.

Such a process may include determining an optimization profile for optimizing the operating characteristic based on the optimization model performing the one or more optimization processes, wherein the optimization profile indicates optimized values determined, according to the one or more optimization processes, for the plurality of adjustable parameters. For example, the ECM (e.g., using power system optimizer module 240 and/or optimization mapping module 250) may determine an optimization profile for optimizing the operating characteristic based on the optimization model performing the one or more optimization processes, as described above. In some implementations, the optimization profile indicates optimized values determined, according to the one or more optimization processes, for the plurality of adjustable parameters.

Such a process may include configuring the one or more control devices to control the engine according to the optimization profile. For example, the ECM (e.g., using power system optimizer module 240 and/or optimization mapping module 250) may configure the one or more control devices to control the engine according to the optimization profile, as described above.

Such a process may include additional implementations, such as any single implementation or any combination of implementations described below and/or in connection with one or more other processes described herein.

In some implementations, the one or more optimization processes include a first optimization process and a second optimization process. In some implementations, the optimization model is configured to iteratively perform the first optimization process until a first adjustable parameter, of the plurality of adjustable parameters, is optimized according to the first optimization process, and to iteratively perform the second optimization process until a second adjustable parameter, of the plurality of adjustable parameters, is optimized according to the second optimization process. In some implementations, the ECM, when determining the optimization profile, may include, in the optimization profile, a first optimized value associated with the first adjustable parameter being optimized according to the first optimization process, and a second optimized value associated with the second adjustable parameter being optimized according to the second optimization process.

In some implementations, the optimization model is configured to, after the first adjustable parameter is optimized according to the first optimization process, iteratively perform the second optimization process using the first optimized value for the first adjustable parameter. In some implementations, the optimization model is configured to determine that the plurality of adjustable parameters are optimized based on corresponding values of the plurality of adjustable parameters not changing for a threshold number of iterations of respective ones of the one or more optimization processes.

In some implementations, the one or more optimization processes comprise at least two optimization processes that are iteratively performed to optimize at least two respective adjustable parameters of the plurality of adjustable parameters. In some implementations, the ECM may, when determining the optimization profile, identify the optimized values based on the plurality of adjustable parameters being optimized according to the one or more optimization processes, and set the optimized values, for the plurality of adjustable parameters, that are to be maintained during operation of the engine, by respective ones of the one or more control devices, to optimize the operating characteristic.

In some implementations, the ECM may, when configuring the one or more control devices to control the operation of the engine, correspondingly cause the one or more control devices to control the engine according to respective optimized values of the optimization profile.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

Figure 4:
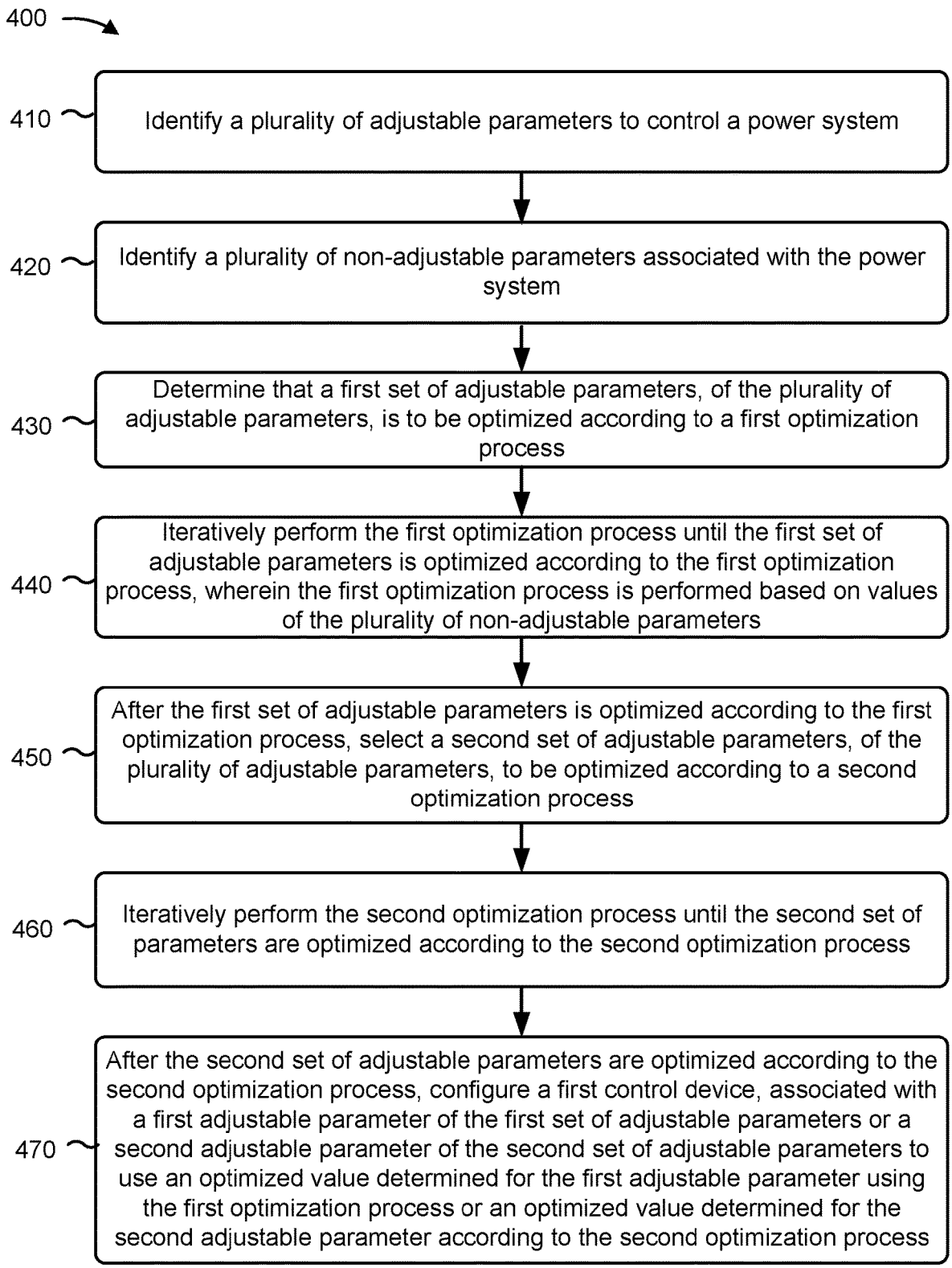
FIG. 4 is a flow chart of an example process associated with power system optimization.

FIG. 4 is a flow chart of an example process 400 associated with power system optimization. In some implementations, one or more process blocks of FIG. 4 may be performed by an ECM (e.g., ECM 40 using power system optimizer module 230 and/or optimization mapping module 240). In some implementations, one or more process blocks of FIG. 4 may be performed by another device or a group of devices separate from or including the ECM, such as control devices (e.g., control devices 210) and/or sensors (e.g., sensors 220) of a system (e.g., power system 10 and/or optimization system 200).

As shown in FIG. 4, process 400 may include identifying a plurality of adjustable parameters to control a power system (block 410). For example, the ECM (e.g., using power system optimizer module 230) may identify a plurality of adjustable parameters to control power to a power system, as described above.

As further shown in FIG. 4, process 400 may include identifying a plurality of non-adjustable parameters associated with the power system (block 420). For example, the ECM (e.g., using power system optimizer module 230) may identify a plurality of non-adjustable parameters associated with the power system, as described above.

As further shown in FIG. 4, process 400 may include determining that a first set of adjustable parameters, of the plurality of adjustable parameters, is to be optimized according to a first optimization process (block 430). For example, the ECM (e.g., using power system optimizer module 230) may determine that a first set of adjustable parameters, of the plurality of adjustable parameters, is to be optimized according to a first optimization process, as described above.

As further shown in FIG. 4, process 400 may include iteratively performing the first optimization process until the first set of adjustable parameters is optimized according to the first optimization process, wherein the first optimization process is performed based on values of the plurality of non-adjustable parameters (block 440). For example, the ECM (e.g., using power system optimizer module 230 and/or optimization mapping module 240) iteratively perform the first optimization process until the first set of adjustable parameters is optimized according to the first optimization process, as described above. In some implementations, the first optimization process is performed based on values of the plurality of non-adjustable parameters.

As further shown in FIG. 4, process 400 may include, after the first set of adjustable parameters is optimized according to the first optimization process, select a second set of adjustable parameters, of the plurality of adjustable parameters, to be optimized according to a second optimization process (block 450). For example, after the first set of adjustable parameters is optimized according to the first optimization process, the ECM (e.g., using power system optimizer module 230) may select a second set of adjustable parameters, of the plurality of adjustable parameters, to be optimized according to a second optimization process, as described above.

As further shown in FIG. 4, process 400 may include iteratively performing the second optimization process until the second set of parameters are optimized according to the second optimization process (block 460). For example, the ECM (e.g., using power system optimizer module 230 and/or optimization mapping module 240) may iteratively perform the second optimization process until the second set of parameters are optimized according to the second optimization process, as described above.

As further shown in FIG. 4, process 400 may include, after the second set of adjustable parameters are optimized according to the second optimization process, configuring a first control device, associated with a first adjustable parameter of the first set of adjustable parameters or a second adjustable parameter of the second set of adjustable parameters to use an optimized value determined for the first adjustable parameter using the first optimization process or an optimized value determined for the second adjustable parameter according to the second optimization process (block 470). For example, after the second set of adjustable parameters are optimized according to the second optimization process, the ECM (e.g., using power system optimizer module 230 and/or optimization mapping module 240) may configure a first control device, associated with a first adjustable parameter of the first set of adjustable parameters or a second adjustable parameter of the second set of adjustable parameters to use an optimized value determined for the first adjustable parameter using the first optimization process or an optimized value determined for the second adjustable parameter according to the second optimization process, as described above.

Process 400 may include additional implementations, such as any single implementation or any combination of implementations described below and/or in connection with one or more other processes described elsewhere herein.

In some implementations, the plurality of adjustable parameters are settings for corresponding control devices of the power system and the plurality of non-adjustable parameters correspond to measurements of one or more sensors of the power system. In some implementations, the one or more processors are to determine that the first set of adjustable parameters are to be optimized based on optimization characteristics of the first set of adjustable parameters.

In some implementations, each iteration of the first optimization process includes iteratively adjusting values of the first set of adjustable parameters to identify the optimized value determined for the first adjustable parameter using the first optimization process. In some implementations, each iteration of the second optimization process includes iteratively adjusting values of the second set of adjustable parameters to identify the optimized value determined for the second adjustable parameter using the second optimization process. In some implementations, the optimized value determined for the second adjustable parameter using the second optimization process comprises a minimum cost function value for the second optimization process.

In some implementations, after each iteration of the first optimization process, the ECM may set optimization values for the plurality of adjustable parameters based on optimized values found for the first set of adjustable parameters according to the first optimization process. In some implementations, after each iteration of the second optimization process, the ECM may set the optimization values for the plurality of adjustable parameters based on optimized values found for the second set of adjustable parameters according to the second optimization process. In some implementations, the ECM may configure corresponding control devices associated with the plurality of adjustable parameters to operate within the power system using the optimization values to optimize performance features of the power system.

In some implementations, the ECM may determine that the first adjustable parameter of the first set of adjustable parameters is optimized based on a value of the first adjustable parameter not changing for a first number of iterations of the first optimization process and determine that the second adjustable parameter of the second set of adjustable parameters is optimized based on values of the second adjustable parameter not changing for a second number of iterations of the second optimization process. In some implementations, the first optimization process and the second optimization process are a same type of optimization process.

In some implementations, the power system includes an engine under operation and the first set of adjustable parameters includes at least one of a quantity of fuel injected into a cylinder of the engine, a timing of when the fuel is injected into the cylinder of the engine, or a pressure of the fuel that is to be injected into the cylinder of the engine. In some implementations, the second set of adjustable parameters includes at least one of: a pressure of air that enters the cylinder, a number of cylinders of the engine that are to receive fuel during operation, mass flow of an auxiliary regeneration device of an aftertreatment system of the power system, a position of an exhaust backpressure valve, a position of an intake throttle valve, a shot mode of the engine corresponding to a number of shots of fuel that are used to inject the fuel, an amount of time between shots of fuel into the cylinder in a multi-shot mode, and an amount of fuel per shot in a multi-shot mode.

In some implementations, one adjustable parameter of the first set of adjustable parameters is a same adjustable parameter as one adjustable parameter of the second set of adjustable parameters. In some implementations, after the first set of adjustable parameters are optimized according to the first optimization process, the ECM may configure a second control device, associated with a third adjustable parameter of the first set of adjustable parameters, to use an optimized value determined for the third adjustable parameter using the first optimization process.

Additionally, or alternatively, a process, as described herein, may include receiving measurements associated with one or more sensors. For example, the ECM (e.g., using power system optimizer module 230) may receive measurements associated with one or more sensors, as described above.

Such a process may include identifying settings associated with the one or more control devices. For example, the ECM (e.g., using power system optimizer module 230) may identify settings associated with one or more control devices, as described above.

Such a process may include determining that a first set of parameters associated with the one or more control devices is to be optimized according to a first optimization process. For example, the ECM (e.g., using power system optimizer module 230) may determine that a first set of parameters associated with the one or more control devices is to be optimized according to a first optimization process, as described above.

Such a process may include iteratively performing the first optimization process until the first set of parameters are optimized according to the first optimization process, wherein the first optimization process is performed based on the measurements associated with the one or more sensors. For example, the ECM (e.g., using power system optimizer module 230 and/or optimization mapping module 240) may iteratively perform the first optimization process until the first set of parameters are optimized according to the first optimization process. In some implementations, the first optimization process is performed based on the measurements associated with the one or more sensors.

Such a process may include determining that a second set of parameters associated with the one or more control devices are to be optimized according to a second optimization process. For example, the ECM (e.g., using power system optimizer module 230) may determine that a second set of parameters associated with the one or more control devices are to be optimized according to a second optimization process, as described above.

Such a process may include iteratively performing the second optimization process until the second set of parameters are optimized according to the second optimization process, wherein the second optimization process is performed based on the measurements associated with the one or more sensors and a first setting for a first control device of the one or more control devices, wherein the first setting for the first control device is an optimized value determined using the first optimization process. For example, the ECM (e.g., using power system optimizer module 230 and/or optimization mapping module 240) may iteratively perform the second optimization process until the second set of parameters are optimized according to the second optimization process, as described above. In some implementations, the second optimization process is performed based on the measurements associated with the one or more sensors and a first setting for a first control device of the one or more control devices. In some implementations, the first setting for the first control device is an optimized value determined using the first optimization process.

Such a process may include, after the second set of parameters are optimized according to the second optimization process, configuring a second control device of the one or more control devices to operate using an optimized value for the second control device determined using the second optimization process. For example, after the second set of parameters are optimized according to the second optimization process, the ECM (e.g., using power system optimizer module 230 and/or optimization mapping module 240) may configure a second control device of the one or more control devices to operate using an optimized value for the second control device determined using the second optimization process.

Such a process may include additional implementations, such as any single implementation or any combination of implementations described below and/or in connection with one or more other processes described herein.

In some implementations, the first set of parameters includes a same number of parameters as the second set of parameters. In some implementations, the ECM may randomly select the second set of parameters from a plurality of parameters associated with the one or more control devices. In some implementations, the plurality of parameters are designated to be optimized after the first set of parameters are optimized using the first optimization process.

In some implementations, the first set of parameters are optimized using the first optimization process when a threshold number of parameters of the first set of parameters are found to have a same value after a first number of iterations. In some implementations, the threshold number of parameters corresponds to all parameters in the first set of parameters.

Additionally, or alternatively, a process, as described herein, may include identifying a first parameter of a plurality of parameters that is to be optimized during operation of an engine of a power system. For example, the ECM (e.g., using power system optimizer module 230) may identify a first parameter of a plurality of parameters that is to be optimized during operation of an engine of a power system, as described above.

Such a process may include selecting a first set of parameters to be optimized according to a first optimization process based on characteristics of each of the first set of parameters, wherein the first set of parameters includes the first parameter. For example, the ECM (e.g., using power system optimizer module 230) may select a first set of parameters to be optimized according to a first optimization process based on characteristics of each of the first set of parameters, as described above. In some implementations, wherein the first set of parameters includes the first parameter.

Such a process may include iteratively performing the first optimization process until each of the first set of parameters is optimized. For example, the ECM (e.g., using power system optimizer module 230 and/or optimization mapping module 240) may iteratively perform the first optimization process until each of the first set of parameters is optimized, as described above.

Such a process may include configuring a first control device to operate based on an optimized value, for at least one of the first set of parameters, determined using the first optimization process. For example, the ECM (e.g., using power system optimizer module 230 and/or optimization mapping module 240) may configure a first control device to operate based on an optimized value, for at least one of the first set of parameters, determined using the first optimization process, as described above.

Such a process may include, after the first set of parameters is optimized, selecting a second set of parameters to be optimized according to a second optimization process, wherein the second set of parameters includes the first parameter. For example, after the first set of parameters is optimized, the ECM (e.g., using power system optimizer module 230) may select a second set of parameters to be optimized according to a second optimization process, as described above. In some implementations, the second set of parameters includes the first parameter.

Such a process may include iteratively performing the second optimization process until each of the second set of parameters is optimized. For example, the ECM (e.g., using power system optimizer module 230 and/or optimization mapping module 240) may iteratively perform the second optimization process until each of the second set of parameters is optimized, as described above.

Such a process may include configuring a second control device to operate based on an optimized value, for at least one of the second set of parameters, determined using the second optimization process. For example, the ECM (e.g., using power system optimizer module 230) may configure a second control device to operate based on an optimized value, for at least one of the second set of parameters, determined using the second optimization process, as described above.

Such a process may include additional implementations, such as any single implementation or any combination of implementations described below and/or in connection with one or more other processes described herein.

In some implementations, the first parameter comprises a quantity of fuel injected into a cylinder of the engine during operation. In some implementations, the first set of parameters includes a same number of parameters as the second set of parameters. In some implementations, the first control device and the second control device are a same control device and the optimized value, for the at least one of the second set of parameters, is greater than or less than the optimized value for the at least one of the first set of parameters. In some implementations, a second parameter, of the second set of parameters, is randomly selected, from the plurality of parameters, to be optimized using the second optimization process. In some implementations, the first parameter is designated to be optimized using the second optimization process. In some implementations, the second parameter is different than the first parameter.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

An engine is a complex system. There are multiple parameters that can impact one or more operating characteristics of the engine. For example, such operating characteristics may include a usage rate associated with the power system, a performance characteristic associated with the power system (e.g., fuel consumption, speed, transient response, torque delivered vs. torque desired, and/or the like), a cost associated with operating the engine, and/or the like. Some parameters may be adjustable (e.g., timing, fuel quantity, fuel injection pressure, EGR flow, boost pressure (air intake pressure), and/or the like). Some parameters are not adjustable (e.g., ambient conditions, exhaust restrictions, and/or the like). An ECM may be configured to optimize a fixed set of parameters. As such, though a set of parameters may have been found to be optimized, because the set of parameters that are to be optimized is fixed, the ECM may continue to attempt to optimize the set of parameters. In such cases, the ECM may waste resources (e.g., processing resources, power resources, and/or the like) attempting to optimize the parameters because the optimized values for the fixed set of parameters have already been found.

Furthermore, such an optimization process, in previous techniques, may not take into account one or more operating characteristics that are to be optimized for the engine. For example, an operator associated with a machine may prefer that the machine be configured to optimize a performance characteristic, but the ECM may be configured to optimize the power system to optimize a cost and/or usage rate (which may translate to an extended life of the power system). Therefore, the operator may not achieve the performance desired because the optimization processes performed are configured to optimize the costs and/or usage rate.

According to some implementations described herein, a power system optimization calibration is performed that allows an ECM to determine optimized values for one or more adjustable parameters in order to optimize an operating characteristic associated with the power system. Furthermore, the ECM may determine optimized values for as many adjustable parameters as possible (according to the one or more optimization processes) during operation and/or determine optimized values for a variable number of adjustable parameters during operation.

Accordingly, as described herein, an optimization process can be configured according to calibration information to allow for customizable configurations of the optimization process. Furthermore, the optimization process may dynamically be controlled and/or adjusted to optimize the one or more operating characteristics of the power system. In this way, the ECM may be configured to conserve a life expectancy (e.g., by optimizing a usage rate of the power system), one or more costs associated with operating the power system, one or more performance characteristics associated with operating the power system, and/or the like.

As described herein, variable sets of parameters can be optimized at a given time to optimize one or more operating characteristics of a power system, allowing for an increased number of parameters to be optimized relative to previous techniques. In some implementations, an ECM may iteratively perform an optimization process every threshold period of time (e.g., 400 ms) to optimize a set of parameters to enhance one or more performance features of the engine. As such, as described herein, a number of parameters that are to be optimized by an iteratively performed optimization process may be limited to a particular number (e.g., four or less, five or less, six or less, and/or the like) to ensure a strong sampling during the optimization process while being able to find optimized values for a plurality of parameters relatively quickly. Further, as described herein, one or more optimization processes, to optimize an operating characteristic of a power system, may be iteratively performed until a set of parameters that are being optimized have been found to be optimized (e.g., by finding an optimized value). Once the set of parameters are determined to be optimized, a subsequent set of parameters may be selected for a subsequent performance optimization. In such cases, the optimized values found by the previous performance optimization may be used to find optimized values for the parameters that are to be optimized by the subsequent performance optimization.

In some implementations, certain parameters may be designated for optimization according to a priority system that is defined by the operating characteristic that is to be optimized. For example, depending on the operating characteristic that is to be optimized, certain parameters may be configured to always be optimized, to be initially optimized, to be optimized after other parameters, to be optimized when possible, and/or to be optimized according to any other priority designation. As a result, a system can be configured to ensure that at least one parameter (e.g., fuel quantity, timing, and/or the like) is always being optimized, while other parameters can be optimized along with the fuel quantity according to a prioritization scheme. Consequently, power system optimization techniques as described herein can enable various operating characteristics of a power system to be optimized by determining optimized values for adjustable parameters associated with the power system.

Accordingly, as described herein, one or more processes and/or techniques for power system optimization may enable optimized performance of various operating characteristics by iteratively selecting and optimizing corresponding sets of parameters according to the operating characteristics that are to be optimized. Further, as the power system optimization is performed over time, as described herein, more and more parameters (and more and more combinations of parameters) can be optimized, allowing for all performance features, or at least various sets or various numbers of performance features (rather than a fixed set or fixed number of features), to be optimized according to the optimization processes described herein to permit the operating characteristics to be optimized. As a result, various costs (e.g., fuel costs, emissions, and/or the like) and/or resources (e.g., processing resources, power resources, and/or the like) associated with operating an engine can be conserved relative to previous techniques.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise forms disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. An engine control module, comprising:

a memory; and one or more processors configured to:

receive calibration information to optimize an operating characteristic associated with operating a power system;

determine an optimization profile for operating the power system using an optimization model, wherein the optimization profile is configured to specify optimized values for a plurality of adjustable parameters of the power system, and wherein the optimization model is configured to:

iteratively perform one or more optimization processes to determine, according to the one or more optimization processes, potential optimized values for the plurality of adjustable parameters to control the power system, and selectively designate, within the optimization profile and based on the calibration information, respective optimized values, from the potential optimized values, for the plurality of adjustable parameters; and configure one or more control devices, associated with the plurality of adjustable parameters, according to the optimization profile to control the power system to optimize the operating characteristic, wherein the one or more optimization processes include a first optimization process and a second optimization process, and wherein the optimization model is further configured to:

iteratively perform the first optimization process until a first adjustable parameter, of the plurality of adjustable parameters, is optimized according to the first optimization process, and iteratively perform the second optimization process until a second adjustable parameter, of the plurality of adjustable parameters, is optimized according to the second optimization process, and wherein the one or more processors, when determining the optimization profile, are further configured to include, in the optimization profile, a first optimized value associated with the first adjustable parameter being optimized according to the first optimization process, and a second optimized value associated with the second adjustable parameter being optimized according to the second optimization process.

2. The engine control module of claim 1, wherein the calibration information is received from at least one of:

a user device associated with a machine of the power system, a user interface tool configured to communicate with the engine control module, or an information platform that provides characteristic information associated with the operating characteristic.

3. The engine control module of claim 1, wherein the optimization model is trained based on historical information associated with the power system, or one or more other power systems, optimizing the operating characteristic, wherein the historical information includes previous optimization profiles that include previous optimized values associated with the plurality of adjustable parameters, and wherein the previous optimized values were previously used to control the power system or the one or more other power systems.

4. The engine control module of claim 1, wherein the optimization model is further configured to perform the one or more optimization processes based on measurements received from one or more sensors that monitor the power system during operation, and wherein one or more of the measurements indicate whether or not the operating characteristic is being optimized.

5. The engine control module of claim 1, wherein the one or more processors, when configuring the control devices, are further configured to set the one or more control devices to control the power system to operate according to respective optimized values associated with the plurality of adjustable parameters identified in the optimization profile.

6. The engine control module of claim 1, wherein the power system includes an engine under operation and the plurality of adjustable parameters include at least two of:

a quantity of a fuel injected into a cylinder of the engine, a timing of when a fuel is injected into a cylinder of the engine, a pressure of a fuel that is to be injected into a cylinder of the engine, a pressure of air that enters a cylinder, a number of cylinders of the engine that are to receive a fuel during operation, a mass flow of an auxiliary regeneration device of an aftertreatment system of the power system, a position of an exhaust backpressure valve, a position of an intake throttle valve, a shot mode of the engine corresponding to a number of shots of a fuel that are used to inject the fuel into a cylinder, an amount of time between shots of a fuel into a cylinder in a multi-shot mode, or an amount of a fuel per shot in a multi-shot mode.

7. The engine control module of claim 1, wherein the operating characteristic comprises at least one of:

a usage rate associated with the power system, a performance characteristic associated with the power system, or a cost associated with operating the power system.

8. A power system comprising:

an engine;

one or more control devices;

one or more sensors;

one or more calibration devices; and an engine control module configured to:

receive, from the one or more calibration devices, calibration information, wherein the calibration information indicates an operating characteristic of the engine that is to be optimized;

based on receiving the calibration information, configure an optimization model of the engine control module, wherein the optimization model is configured to perform one or more optimization processes, according to the calibration information and based on measurements received from the one or more sensors, to optimize a plurality of adjustable parameters associated with one or more of the one or more control devices;

determine an optimization profile for optimizing the operating characteristic based on the optimization model performing the one or more optimization processes, wherein the optimization profile indicates optimized values determined, according to the one or more optimization processes, for the plurality of adjustable parameters; and configure the one or more control devices to control the engine according to the optimization profile, wherein the one or more optimization processes include a first optimization process and a second optimization process, and wherein the optimization model is further configured to:

iteratively perform the first optimization process until a first adjustable parameter, of the plurality of adjustable parameters, is optimized according to the first optimization process, and iteratively perform the second optimization process until a second adjustable parameter, of the plurality of adjustable parameters, is optimized according to the second optimization process, and wherein the engine control module, when determining the optimization profile, is further configured to include, in the optimization profile, a first optimized value associated with the first adjustable parameter being optimized according to the first optimization process, and a second optimized value associated with the second adjustable parameter being optimized according to the second optimization process.

9. The power system of claim 8, wherein the optimization model is further configured to after the first adjustable parameter is optimized according to the first optimization process, iteratively perform the second optimization process using the first optimized value for the first adjustable parameter.

10. The power system of claim 8, wherein the optimization model is further configured to determine that the plurality of adjustable parameters are optimized based on corresponding values of the plurality of adjustable parameters not changing for a threshold number of iterations of respective ones of the one or more optimization processes.

11. The power system of claim 8, wherein the one or more optimization processes comprise at least two optimization processes that are iteratively performed to optimize at least two respective adjustable parameters of the plurality of adjustable parameters.

12. The power system of claim 8, wherein the engine control module, when determining the optimization profile, is further configured to:

identify the optimized values based on the plurality of adjustable parameters being optimized according to the one or more optimization processes; and set the optimized values, for the plurality of adjustable parameters, that are to be maintained during operation of the engine, by respective ones of the one or more control devices, to optimize the operating characteristic.

13. The power system of claim 8, wherein the engine control module, when configuring the one or more control devices to control operation of the engine, is further configured to correspondingly cause the one or more control devices to control the engine according to respective optimized values of the optimization profile.

14. A method, comprising:

receiving calibration information associated with optimizing an operating characteristic of a power system;

determining, using an optimization model, an optimization profile to optimize the operating characteristic, wherein the optimization model is configured to perform one or more optimization processes to determine, according to the calibration information, optimized values associated with a plurality of adjustable parameters of the power system, wherein the optimization profile is configured to include the optimized values; and configuring a first control device, associated with a first adjustable parameter of the plurality of adjustable parameters, according to the optimization profile, wherein the first control device is configured to control a first component of an engine of the power system to be set according to an optimized value for the first adjustable parameter, wherein the one or more optimization processes include a first optimization process and a second optimization process, and wherein the optimization model is further configured to:

iteratively perform the first optimization process until a first adjustable parameter, of the plurality of adjustable parameters, is optimized according to the first optimization process, and iteratively perform the second optimization process until a second adjustable parameter, of the plurality of adjustable parameters, is optimized according to the second optimization process, and wherein the optimization model, when determining the optimization profile, is further configured to include, in the optimization profile, a first optimized value associated with the first adjustable parameter being optimized according to the first optimization process, and a second optimized value associated with the second adjustable parameter being optimized according to the second optimization process.

15. The method of claim 14, wherein the calibration information is received, from a user interface, within a user input, wherein the user interface is configured to enable a user to calibrate the power system via an engine control module, and wherein the calibration information specifies the operating characteristic to cause the optimization profile to be determined.

16. The method of claim 14, wherein the calibration information includes a variable associated with the operating characteristic, the method further comprising determining, based on the variable and before determining the optimization profile, that the operating characteristic is to be optimized.

17. The method of claim 14, wherein the optimization model is configured to perform the one or more optimization processes based on measurements received from sensors that monitor the engine.

18. The method of claim 14, wherein the optimization model is trained based on historical information associated with the power system optimizing the operating characteristic, wherein the historical information includes previous optimization profiles that include previous optimized values associated with the plurality of adjustable parameters, and wherein the previous optimized values were previously used to control the engine.

19. The method of claim 14, further comprising configuring a second control device, associated with a second adjustable parameter of the plurality of adjustable parameters, according to the optimization profile, wherein the second control device is configured to control a second component of the power system to be set according to an optimized value for the second adjustable parameter.

* * * * *